US007004366B2

(12) United States Patent
Schiestl et al.

(10) Patent No.: US 7,004,366 B2
(45) **Date of Patent: *Feb. 28, 2006**

(54) INTERNAL COMBUSTION-OPERATED SETTING TOOL

(75) Inventors: Ulrich Schiestl, Feldkirch (AT); Ulrich Rosenbaum, Wangs (CH); Iwan Wolf, Chur (CH); Hans Gschwend, Buchs (CH); Peter Hertlein, Gams (CH)

(73) Assignee: Hilti Aktiengesellschaft, Schaan ( * ) Notice: Subject to any disclaimer, the term of this patent is extended or adjusted under 35 U.S.C. 154(b) by 0 days.

This patent is subject to a terminal disclaimer.

(21) Appl. No.: 10/743,168

(22) Filed: Dec. 22, 2003

(65) Prior Publication Data

US 2004/0134960 A1 Jul. 15, 2004

(30) Foreign Application Priority Data

Dec. 23, 2002 (DE) ..... 102 60 702

(51) Int. Cl.
*B25C 1/14* (2006.01)

(52) U.S. Cl. ..... 227/8; 227/10; 227/130; 123/46 SC

(58) Field of Classification Search ..... 227/8, 227/10, 130, 2, 5; 123/46 SC, 46 R
See application file for complete search history.

(56) References Cited

U.S. PATENT DOCUMENTS

| | | | | |
|---|---|---|---|---|
| 3,788,195 | A * | 1/1974 | Lange | 227/130 |
| 3,967,771 | A * | 7/1976 | Smith | 227/10 |
| 4,211,352 | A * | 7/1980 | Zilka | 227/130 |
| 5,000,128 | A * | 3/1991 | Veldman | 123/46 SC |
| 6,279,517 | B1 * | 8/2001 | Achten | 123/46 R |
| 6,634,325 | B1 * | 10/2003 | Adams | 123/46 R |
| 6,666,366 | B1 * | 12/2003 | Rosenbaum et al. | 227/8 |
| 6,722,548 | B1 * | 4/2004 | Odoni et al. | 227/8 |
| 6,783,047 | B1 * | 8/2004 | Granacher | 227/10 |
| 6,786,379 | B1 * | 9/2004 | Largo | 227/10 |

* cited by examiner

*Primary Examiner*—Scott A. Smith
(74) *Attorney, Agent, or Firm*—Abelman, Frayne & Schwab

(57) ABSTRACT

The present invention relates to an internal combustion-operated setting tool for driving fastener elements such as nails, bolts, pins into a substrate, having a fuel source, with a fuel feed line from a fuel source to a combustion chamber and having at least one dosing device (30), which is arranged between the fuel source and the combustion chamber. For improving such setting tools, a displacement body (50) is arranged in a chamber in the dosing device (30) for forcing fuel out of the chamber, whose displacement volume can be adjusted.

11 Claims, 4 Drawing Sheets

INTERNAL COMBUSTION-OPERATED SETTING TOOL

BACKGROUND OF THE INVENTION

1. Field of the Invention

The present invention relates to an internal combustion-operated setting tool for driving fastener elements such as nails, bolts, pins into a substrate, having a fuel source, with a fuel feed line from a fuel source to a combustion chamber and having at least one dosing device, which is arranged between the fuel source and the combustion chamber. A displacement body is arranged in a chamber in the dosing device for forcing fuel out of the chamber. This type of setting tool can be operated using gaseous or liquid fuels, that are burnt in a combustion chamber and wherein a drive piston for fastening elements is driven.

2. Description of the Prior Art

Generally, there is the problem of dosing the fuel for each work cycle with a calibrated quantity of a corresponding air or oxygen mix as the oxidation agent. The oxygen quantity available for the combustion process is heavily dependent on the ambient temperature as well as on the air pressure and humidity. The required fuel quantity therefore varies with the aforementioned parameters quite substantially—in the extreme case up to 40%. These variations can have adverse ramifications on the combustion of the air-fuel mixture if the air-fuel mixture is too rich or too lean in fuel. It is therefore desirable to match the fuel quantity to the respective ambient conditions.

An internal combustion-operated setting tool of this general type is described in EP 0 597 241, wherein the metered feed of the fuel from the fuel source to the combustion chamber is done via a dosing device, which comprises a valve actuated by a solenoid, which is normally closed. The actuation is effected electronically by a switch circuit, which reacts to a switch and opens the valve for a controllable set time interval to enable a flow of the fuel from the fuel source to the combustion chamber.

The drawback is that with varying upstream pressure in the fuel source, the flow rate of the fuel is variable and accordingly results in imprecise dose quantities.

DE 42 43 617 A1 further discloses a setting tool, wherein a gas inlet valve is mechanically opened, in a work cycle, such that fuel from a fuel source reaches a holding space, which communicates with the environmental air. A pressure or eventually a temperature equalization with the environmental air can take place via this connection, such that an adapted air-fuel mixture reaches the combustion chamber. From this holding space the fuel then reaches the combustion chamber at the appropriate time. The disadvantage is that a fuel loss can occur via the communication to the environmental air. In addition, the pressure in the dosing chamber cannot be regulated.

SUMMARY OF THE INVENTION

The object of the present invention therefore resides in developing a setting tool of the aforementioned type, which prevents the aforementioned drawbacks and in which an exact dosing of the fuel is assured. This is achieved according to the invention when the dosing system comprises a displacement body arranged in a chamber, whose displacement volume and dosing quantity can be set or changed. The inside volumes of the dosing chamber or the reservoir space is constant in the start position of the displacement body. The dose quantity can thus be set in simple fashion by the volume displaced by the displacement body. The displacement body thus assumes simultaneous pushing out of the fuel dose quantity from the dosing device. A very simple construction and high functionality of the dosing device can be achieved by this double function and the fuel quantity can be matched to the environmental conditions.

It can be advantageous if the displacement volume of the displacement body is adjustable using a control device. This control device can be mechanical or electronic. The user of the setting tool according to the invention no longer has to make the adjustment of the displacement volume himself since this adjustment is taken over by the control device. The device is thus very easy to operate.

In an advantageous embodiment of the setting tool, a manually actuated setting means is provided on the setting tool, in which the displacement volume of the displacement body can be set by the user. Such a means is, for example, a knurled wheel on the outside of the device or a slider switch. In this fashion, a plurality of switch settings or even continuous setting can be done.

In an advantageous further embodiment of the setting tool, sensor means are provided on the tool for picking of device and environmental parameters for forwarding the collected data to the control device. The control device can set the required fuel quantity for each work cycle of the setting tool as a factor of the parameters determined by the sensor means and correspondingly control the displacement volume of the displacement body. These parameters can include the air pressure, atmospheric humidity, air temperature and the device temperature.

The sensor means advantageously comprise sensors for determining the air pressure, the temperature and the humidity of the ambient air. Furthermore, a sensor can also be provided for acquiring the internal temperature of the combustion chamber. Measured data can be collected by these sensors in sufficient quantity, that can be used for the determination of an ideal oxidation agent-fuel mixture.

It is of further advantage if the chamber that is configured as a dosing chamber has an inlet and an outlet through which the dosing chamber is connected to the fuel source, on the one hand, and with the combustion chamber, on the other hand. Advantageously, valve means such as non-return valves are arranged both at the inlet and at the outlet, which allow fuel transport only in the direction of the combustion chamber. Incorrect quantities at the time of dosing of the fuel are thereby prevented since it is assured that the total displaced fuel is supplied to the combustion chamber.

In an advantageous further embodiment of the invention, the displacement body is configured as a piston that is displaceable guided in an optionally cylindrical chamber. The piston stroke, which can be adjusted via the control device or the adjustment means, defines the displacement volume of the displacement body configured as a piston.

In an advantageous alternative embodiment, the displacement body is configured as a membrane, which is arranged in an opening of the dosing chamber that it seals impermeable to the media. The membrane can be moved into the chamber using an appropriate admission means, wherein the membrane stroke, which defines the displacement volumes is adjustable via the control device. The membrane can accordingly be loaded hydraulically using air or an appropriate fluid or using a displaceable plunger. The advantage in the embodiment as a membrane is the easily achieved seal at the interface between the membrane and the chamber.

It can also be advantageous if the displacement body can be loaded using an electrical actuator such as a solenoid, a piezo-element or a motor drive. The displacement body can be moved at a specific displacement such that a fuel quantity with defined volumes is pushed out of the dosing chamber and supplied to the combustion chamber. The actuator then moves the displacement body with an adjustable displacement that corresponds to a certain displacement volume.

The displacement body can, however, be operated mechanically as well. For example, if a compression movement of the setting tool on a substrate can be utilized to move the displacement body into the dosing chamber and to withdraw a fuel quantity that corresponds to the displacement volume from the dosing chamber. The displacement volume is advantageously preset using the setting means or using the control device.

BRIEF DESCRIPTION OF THE DRAWINGS

Other advantages and features of the invention are apparent from the following description with reference to the drawings, wherein.

DETAILED DESCRIPTION OF THE PREFERRED EMBODIMENT

Figure 1:
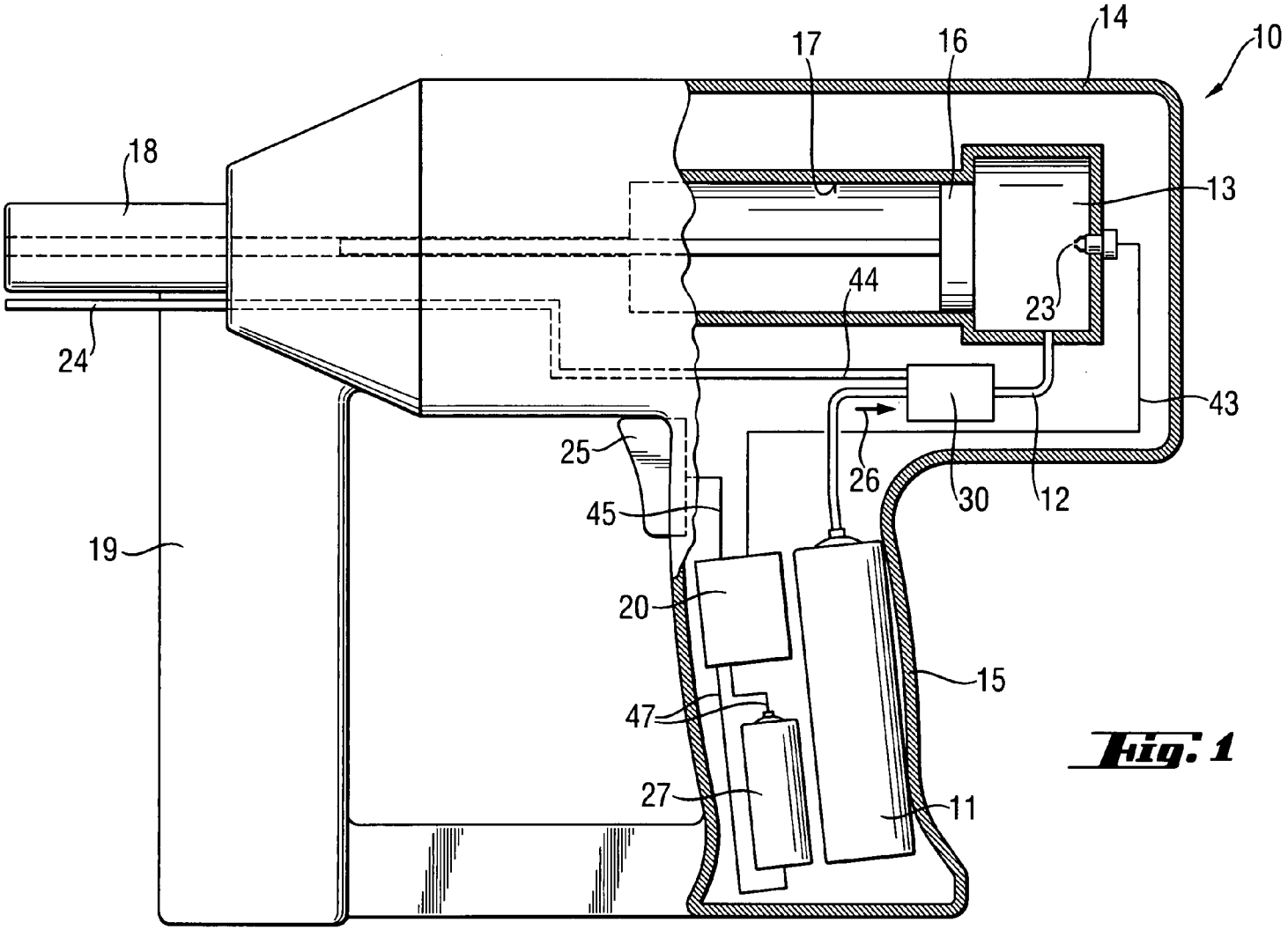
FIG. 1 shows a first embodiment of a setting tool according to the invention, in a partial longitudinal section.
Figure 2:
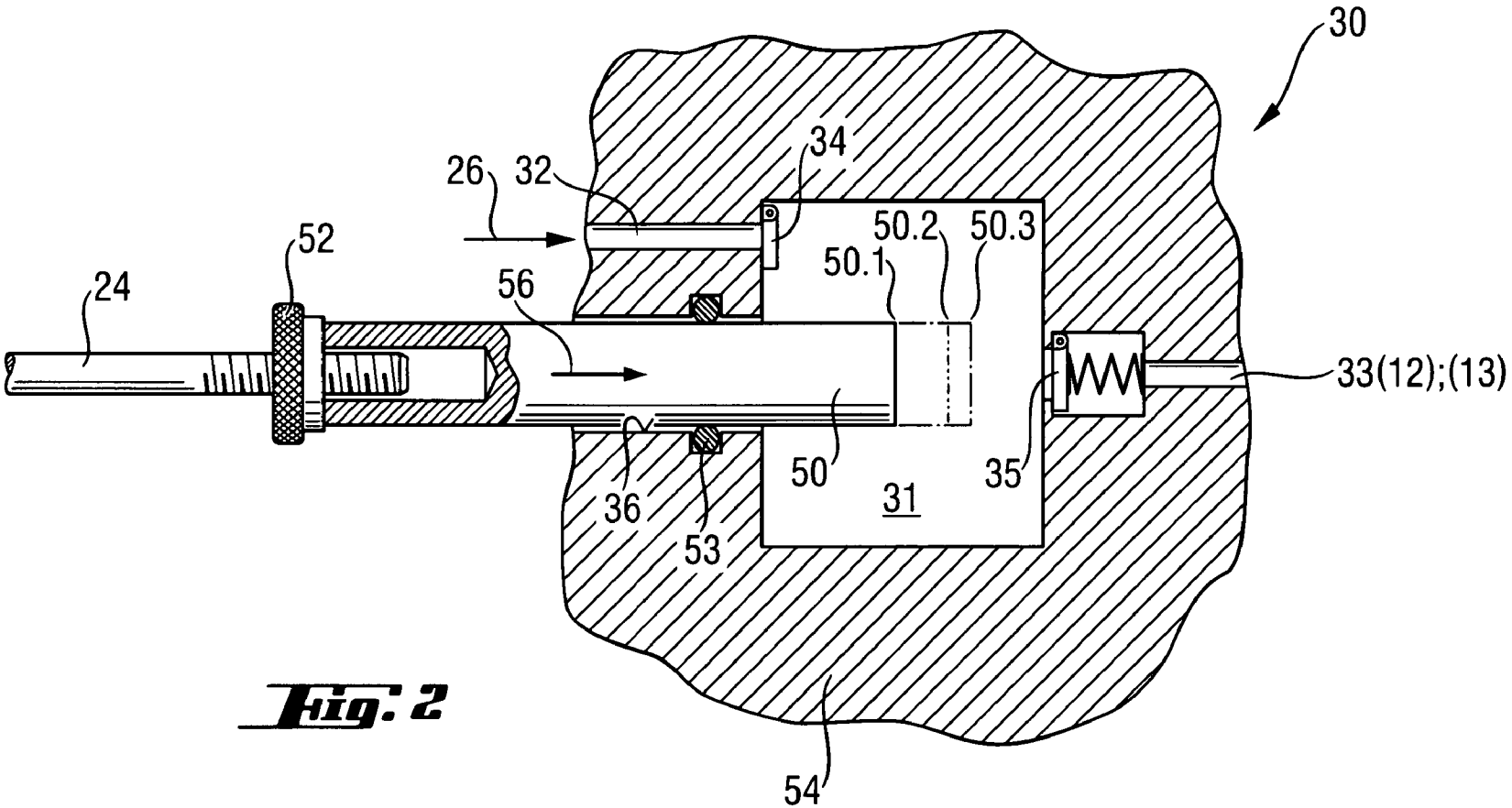
FIG. 2 shows a cutout of the setting tool of FIG. 1 with the dosing system.

FIGS. 1 and 2 show the setting tool 10 according to the invention, in a first embodiment, in its starting or resting position. In this first embodiment, the setting tool 10 is operated using a fuel gas. The setting tool 10 has a housing 14, in which a setting mechanism is arranged, by which a fastener element (not shown) can be driven into a substrate (not shown), when the setting tool is urged against a substrate and triggered.

The setting mechanism comprises inter alia a combustion space or a combustion chamber 13, a piston guide 17, in which a driving piston 16 is displaceable arranged and a bolt guide 18, in which the fastener element can be guided and where a fastener element moves over end of the driving piston moving forward towards the setting end and can be driven into a substrate. The fasteners can be supplied in a magazine 19 on the tool.

In the first embodiment, there is an ignition element in the combustion chamber 13 such as a spark plug 23 for firing a fuel gas—air mixture supplied to the combustion chamber 13. The supply of the fuel gas into the combustion space or the combustion chamber 13 is achieved over a fuel feed line 12 from the fuel reservoir or a fuel source 11. The supply direction of the fuel gas from the fuel reservoir 11 to the combustion chamber 13 is indicated with the reference 26 in FIG. 1.

In addition, the setting tool 10 has an electronic control device 20, which is connected via electrical lines 47 to a power source 27 such as a battery or a battery pack. The control device 20 controls the point in time of firing and accordingly controls the firing unit or the spark plug 23 via the electrical line 43. A setting operation is triggered by the operator by pressing the setting tool 10 against a substrate and by actuating a switch means 25 on a hand grip 15 of the setting tool 10, which forwards the trigger command via an electrical line 45 to the control device 20. When this is done, the setting tool 10 can also be configured without a control device.

In addition, a manually adjustable dosing device 30 is arranged in the fuel feed 12. The dosing device 30 is reproduced in more detail in FIG. 2. The dosing device 30 has a chamber 31 arranged in a housing 54. The chamber 31 is connected via an inlet 32 with the fuel feed 12 from the fuel source 11 (not shown here). The chamber 31 is further connected with the section of the fuel feed 12 leading to the combustion chamber 13 via an outlet 33.

A valve 34 is arranged at the inlet 32, which merely enables an entry/inflow of fuel into the chamber 31. A valve 35 is arranged at the outlet 33, which merely enables exit/outflow of fuel from the chamber 31. A displacement body 50, which is configured as a piston, is glided into an opening 36 to the chamber 31 and sealed against the side wall of the opening 36 using at least one seal element 53. The displacement body 50 is fixed, at its end facing away from the chamber 31, on an actuating means 24, such as a pressure rod (compare also FIG. 1). The maximum stroke of the displacement body 50 in the chamber 31 can be manually set by the user by a setting means 52, such as a knurled screw.

FIG. 2 shows the displacement body 50 initially in its starting position 50.1. If the setting tool 10, in a first position of the setting means 24 is urged against a substrate, then the displacement body 50 is moved in the direction of the arrow 56 to an end position 50.2. With this stroke of the displacement body 50, a fuel volume is forced out of the chamber 31 and guided via the opening spring biased valve 35 through the outlet 33 and the fuel feed line 13 of the combustion chamber.

In another position of the setting means 24, for example, for the operation of the setting tool 10 under cold conditions, the displacement body 50 moves in the direction of the arrow into the end position 50.3, upon urging the setting tool 10. In this longer stroke of the displacement body 50, a fuel volume larger than that described herein is now forced out of the chamber 31 and led off to the combustion chamber 13. In addition, a means for temporarily holding the displacement body 50 in its end position can be provided such that with an intended lifting and urging the setting tool 10, prior to triggering the setting tool 10, prevents a repeat supply of fuel to the combustion chamber 13.

Figure 3:
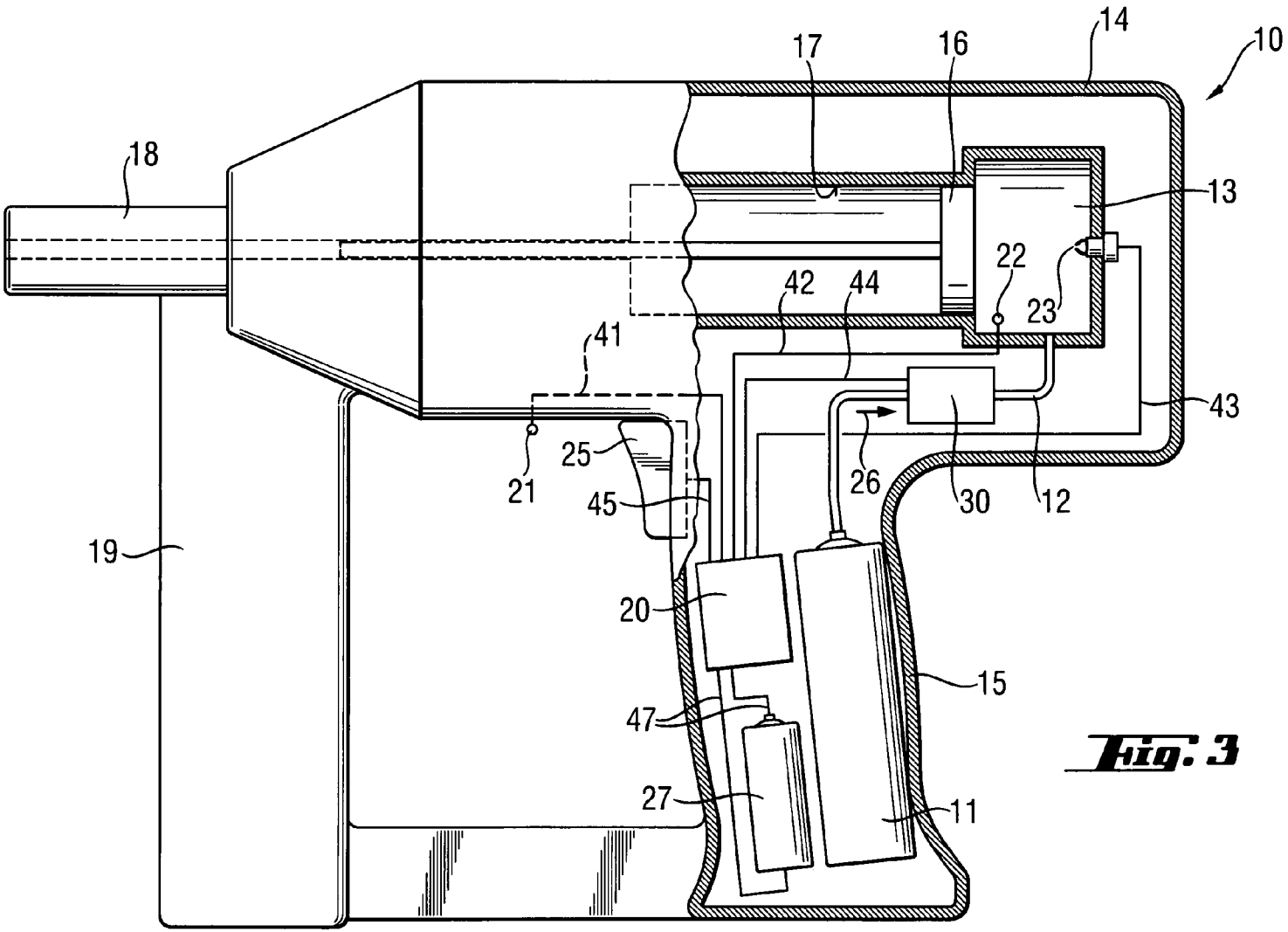
FIG. 3 shows a second embodiment of a setting tool according to the invention, in a partial longitudinal section.
Figure 4:
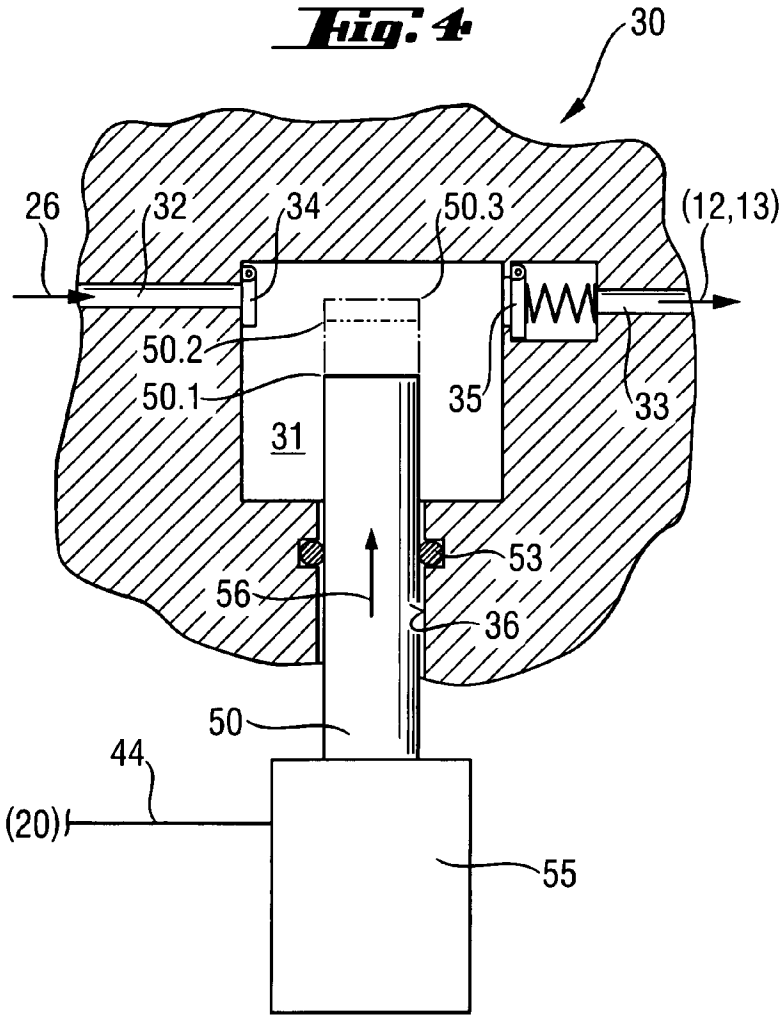
FIG. 4 shows a cutout of the setting tool of FIG. 3 with the dosing device.

The setting tool 10 shown in FIGS. 3 and 4 differs essentially from the setting tool of FIGS. 1 and 2 in that the control device 20 also controls dosing system 30 and the displacement volume of the displacement body 50. In addition, the control device 20 can be equipped with a microprocessor, in which a control program for one or several device functions can run.

The control device 20 is connected via an electrical line 44 with the dosing device 30 using an electrical actuator 55. The control device 20 is connected with the spark plug 23 via the electrical line 43. The switching means 25 or the trigger switch on the hand grip 15 of the setting tool 10 switches electronically and is connected via an electrical line 45 with the control device 20. In addition, in the control device 20, measurement data and parameters from sensors, such as a sensor for acquiring the temperature of the combustion chamber and a sensor 21 for acquiring the temperature and pressure of the ambient air, can be analyzed and converted to control signals. The sensor 22 is connected via the electrical line 42 and the sensor 21 via the electrical line 41 with the control device 20. The electrical lines or connections 41, 42, 43, 44, 43, 47 can be used for the electrical energy supply and for electronic data transfer. Along with the sensors 22, 21, other sensors can transfer measurement data to the control device 20.

Concerning the principal architecture of the dosing device 30, reference is made to the entirety of the above description relative to FIG. 1 and 2. Here, the control of the displacement body 50 is changed, which can be actuated in the direction of the arrow using the electrical actuator 55. The displacement body 50 can be moved dependent on the acquired parameters and the respective control command from the control device 20 to different end positions 50.1, 50.2, 50.3 such that a quantity of fuel corresponding to the displacement volume is supplied in the described manner to the combustion chamber.

Figure 5:
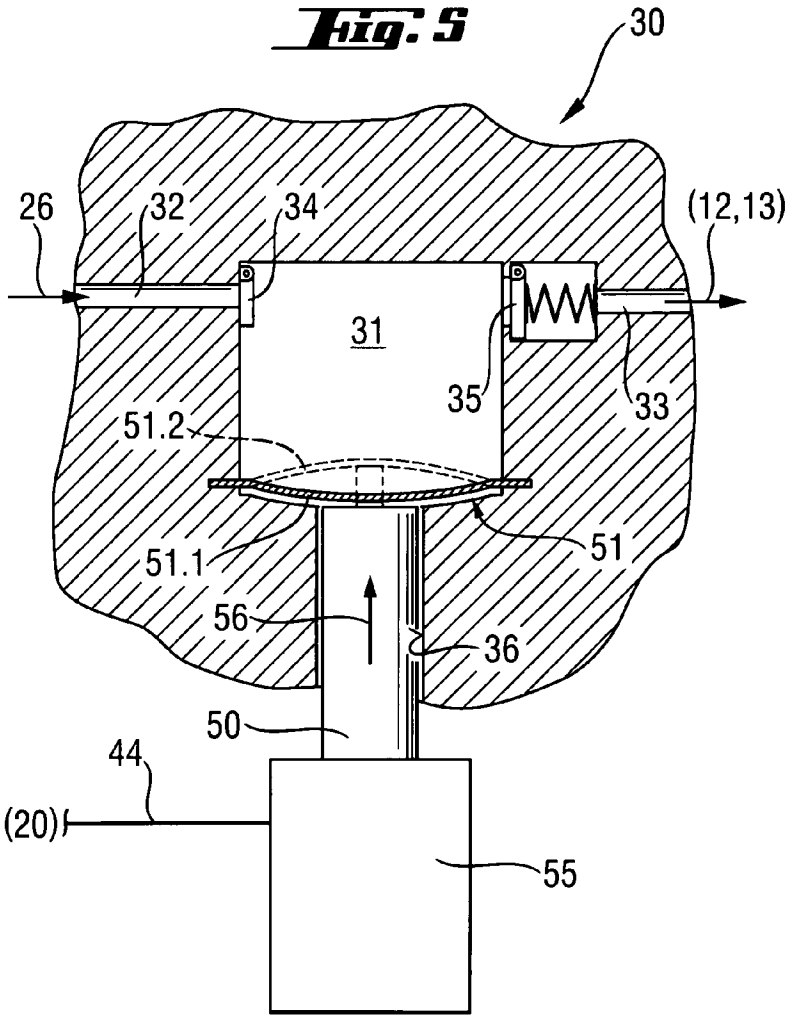
FIG. 5 shows a cutout of a third embodiment of a setting tool according to the invention with the dosing device.

A variant of an electronically controlled dosing device 30 is shown in FIG. 5. The displacement body 51 is configured as a membrane that closes the one opening 36 of the chamber 31. In this example, the displacement body 51 or the membrane can be actuated by an electrical actor 55 and is moveable in the direction 56 from a starting position 51.1 into different end positions 51.2, 51.3.

With regard to FIG. 5, reference is made to the preceding description relative to FIGS. 1 to 4 in their entirety. In addition, it is true that actuation of the displacement body 50, 51 in the exemplary embodiments pursuant to FIG. 3 can be done pulse—like, so that a high flow or current rate of the fuel to the combustion chamber 13 can be achieved. This can be used on an injection nozzle at the end of the fuel feed 12 on the combustion chamber 13 for fine atomization of the fuel.

What is claimed is:

1. An internal combustion driven setting tool for driving fastener elements comprising one of nails, bolts, and pins into a substrates, having a fuel source (11) with a fuel feed line (12) from the fuel source (11) to a combustion chamber (13); and at least one dosing device (30) arranged between the fuel source (11) and the combustion chamber (13), wherein the dosing device (3) comprises a chamber (31) and a displacement body (50, 51) arranged in the chamber for forcing fuel out of the chamber (31), and wherein the displacement body (50, 51) has adjustable displacement volume.

2. The setting tool of claim 1, wherein the displacement volume of the displacement body (50, 51) is adjustable via a control device (20).

3. The setting tool of claim 2, further comprising sensor means for acquiring at least one of device and ambient parameters and for forwarding the acquired data to the control device (20), wherein, in the control device (20), the displacement volume of the displacement body (50, 51) is pre-adjusted as a factor of the acquired parameters.

4. The setting tool of claim 3, wherein the sensor means comprises sensors (21, 22) for acquiring the air pressure and the temperature of the ambient air and the combustion chamber temperature.

5. The setting tool of claim 1, wherein the displacement volume of the displacement body (50, 51) is adjustable using a manually operated setting means (52).

6. The setting tool of claim 1, wherein the chamber (31) has an inlet (32) and an outlet (33) and wherein valves (34, 35) are arranged at the inlet (32) and the outlet (33) of the chamber (31) that make fuel transport possible only in the direction (26) towards the combustion chamber.

7. The setting tool of claim 1, wherein the displacement body (5) is a piston that is displaceable guided in the chamber (31) and includes a piston stroke that defines the displacement volume.

8. The setting tool of claim 1, wherein the displacement body (51) is a membrane that closes an opening (36) to the chamber (31) media-tight and is moveable into the chamber (31), and wherein a membrane stroke defines the displacement volume.

9. The setting tool of claim 1, wherein the displacement body (50, 51) is actuated using an electrical actuator (55).

10. The setting tool of claim 1, wherein the displacement body (50) can be mechanically actuated using an actuation means (24) and can be shifted into a fuel ejection mode.

11. The setting tool of claim 1, wherein the displacement body (50, 51) is excited by the control device (20) and can be shifted in a fuel ejection mode.

* * * * *